United States Patent [19]

Kodama

[11] Patent Number: 4,541,374

[45] Date of Patent: Sep. 17, 1985

[54] HYDRAULIC LIFTER FOR INTERNAL COMBUSTION ENGINE

[75] Inventor: Hisashi Kodama, Nagoya, Japan

[73] Assignee: Aisin Seiki Kabushiki Kaisha, Kariya, Japan

[21] Appl. No.: 563,246

[22] Filed: Dec. 19, 1983

[30] Foreign Application Priority Data

Dec. 29, 1982 [JP] Japan ..... 57-201400[U]

[51] Int. Cl.[4] ..... F01L 1/24

[52] U.S. Cl. ..... 123/90.59; 123/90.35

[58] Field of Search ..... 123/90.35, 90.55, 90.59

[56] References Cited

U.S. PATENT DOCUMENTS

| | | | |
|---|---|---|---|
| 2,325,932 | 8/1943 | Banker | 123/90.59 |
| 2,938,508 | 5/1960 | Papenguth | 123/90.59 |
| 3,070,080 | 12/1962 | Van Slooten | 123/90.59 |
| 4,184,464 | 1/1980 | Svihlik | 123/90.59 X |

*Primary Examiner*—William R. Cline
*Assistant Examiner*—Peggy A. Neils
*Attorney, Agent, or Firm*—Oblon, Fisher, Spivak, McClelland & Maier

[57] ABSTRACT

A hydraulic lifter for an internal combustion engine which includes a cylindrical body installed horizontally or nearly horizontally, having an oil inlet port on the surface of the body; a plunger slidably inserted into the body; a push rod seat inserted into one end of the body in contact with the plunger, having an oil outlet port; an oil reservoir formed by the plunger and a push rod seat; a pressure chamber formed by the internal wall of the body and the end face of the plunger in the other end of the body; a hole for the oil to flow in and out of the reservoir, provided in the vicinity of the junction between the plunger and the push rod seat; a first groove provided on the other surface of the plunger forming at least one turn around the plunger, to connect the oil inlet port mounted on the body with the hole for the oil to flow in and out of the reservoir; and a second groove provided on the outer surface of the push rod seat forming at least one turn around the push rod seat, to connect the hole for the oil to flow in and out of the reservoir with the oil outlet port mounted on the push rod seat.

2 Claims, 3 Drawing Figures

HYDRAULIC LIFTER FOR INTERNAL COMBUSTION ENGINE

BACKGROUND OF THE INVENTION

1. Field of the Invention

The present invention relates to a hydraulic lifter for an internal combustion engine, particularly a hydraulic lifter which is installed horizontally or nearly horizontally.

2. Prior Art of the Invention

A hydraulic lifter which is installed horizontally depending on the condition of engine arrangement is thus far known. During the operation of the engine, the oil supplied from the oil pump circulates so that the oil flows into a reservoir of the hydraulic lifter through an inlet hole provided on the body and flows out through an outlet hole from the reservoir. Accordingly, while the engine operates, the oil does not flow out from the reservoir through the inlet hole provided on the body. However, if the engine stops, the oil also stops circulating. Consequently, the oil in the reservoir flows out through the above inlet and outlet holes, and instead, air flows into the pressure chamber from the reservoir. In this case, when the hydraulic lifter is pressed by the rotation of the cam, the air in the pressure chamber will be crushed. Therefore, a shortage of lifting stroke occurs, whereby a hammering sound occurs at the start of the engine, and a shortage of movement of the intake and exhaust valves occurs.

SUMMARY OF THE INVENTION

The object of the present invention is to provide a horizontally-installed hydraulic lifter which prevents the oil in the reservoir from flowing out one-sidedly through the oil inlet port and the outlet port even during the stopping time of the engine as well as preventing the occurrence of a hammering sound caused by air crush and stroke shortage due to the one-way outflow of the oil from the reservoir and the inflow of air into the pressure chamber.

Another object of the present invention is to provide a hydraulic lifter free from disadvantages such as an increase in the number of necessary parts and difficulty in processing or assembling as in the case where a check valve is mounted on the oil inlet port, and requiring no additional movable parts.

According to the present invention, on the outer surface of the plunger and the push rod seat of the hydraulic lifter are provided grooves spiralling at least one turn around the plunger and push rod. In the hydraulic lifter according to the present invention, an oil reservoir is formed by a plunger and a push rod seat both of which slide in the body of the hydraulic lifter. The oil reservoir is connected with a pressure chamber in the body through a check valve and a leak clearance between said body and plunger. The oil flows into the reservoir through an oil inlet port in the horizontally or nearly horizontally-installed body and flows out of the reservoir through an outlet port. On the outer surface of the plunger is provided a groove spiralling at least one turn around the plunger, which extends from the oil inlet port in said body to a hole for the oil to flow in and out of the reservoir, provided in the vicinity of the junction between said push rod seat and said plunger. In addition, on the outer surface of said push rod seat is provided a groove spiralling at least one turn around the push rod seat which extends from said hole for the inflow and outflow of the oil to an outlet port on the other side. Since the hydraulic lifter is thus composed, the oil which flows into the grooves through the hole for the oil during the stoppage of engine cannot rise to the surfaces of the grooves located above the ceiling of internal surface of the reservoir. Accordingly, although the oil in grooves extending from said surfaces to the oil inlet and outlet ports in the body may flow out, the oil in the reservoir does not reach the oil inlet and outlet ports in the body from the hole for the inflow and outflow of the oil and does not flow out of the body.

The foregoing and other objects, features and advantages of the present invention will be understood more clearly and fully from the following detailed description of preferred embodiments with reference to the attached drawings.

DETAILED DESCRIPTION OF THE PREFERRED EMBODIMENT

Figure 1:
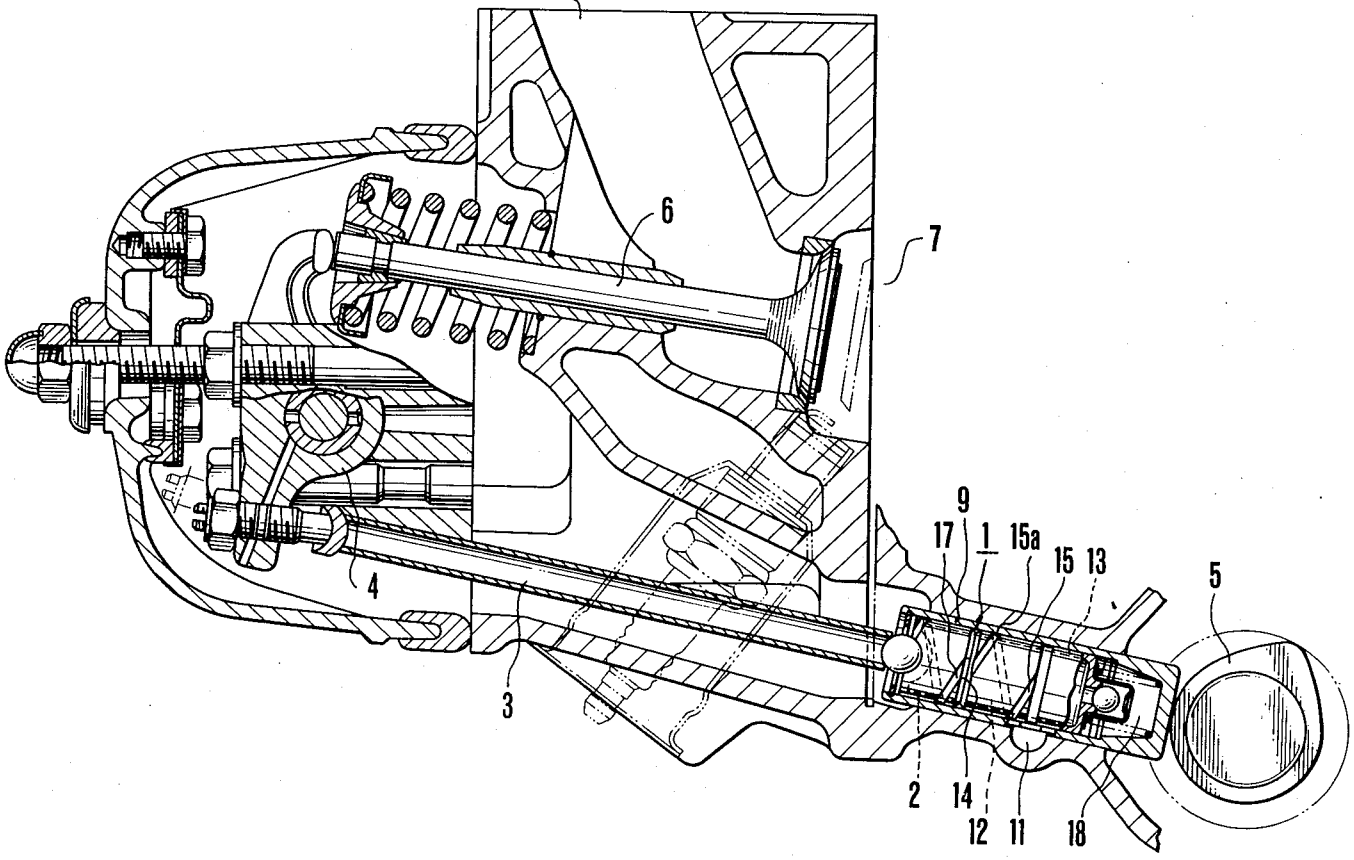
FIG. 1 shows a cross-sectional view of a horizontally-positioned lash adjuster to which one embodiment of the hydraulic lifter of the present invention is applied.

In FIG. 1, one end of a push rod (3) is in contact with a bottomed cylindrical push rod seat (2) which is inserted into one end of a body (9) of a hydraulic lifter(1). The other end of said push rod (3) is in contact with one end of a rocker arm (4). The other end of hydraulic lifter (1) is in contact with a cam (5). The push rod(3) is pushed through the hydraulic lifter (1) by the rotation of the cam (5). When one end of the rocker arm (4) is pushed by the push rod (3), it rocks to press the intake and exhaust valve (6). Consequently, the combustion chamber (7) is connected with the intake and exhaust port (8).

Figure 2:
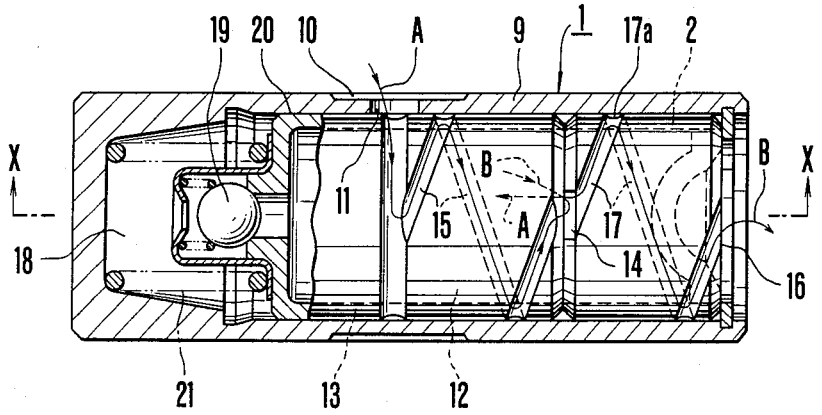
FIG. 2 shows a detailed cross-sectional view of the hydraulic lifter mentioned in FIG. 1.
Figure 3:
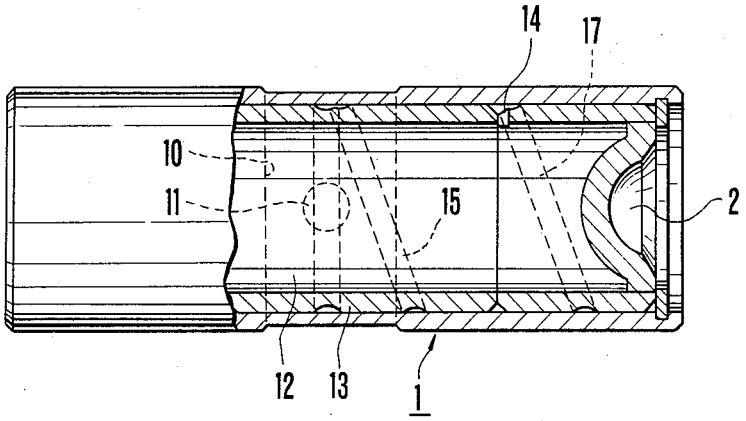
FIG. 3 shows a cross-sectional view along Line X—X of FIG. 2.

In FIGS. 2 and 3, the hydraulic lifter (1) includes a cylindrical body (9) in which circumferential cavity is formed around the body, and an oil inlet port (11) is provided on the bottom of the cavity (10). Inside of the body (9) are a slidable hollow plunger (13) and the push rod seat (2) which is contact with the plunger, constituting a reservoir (12). In the push rod seat is a hole (14) for the oil to flow in and out of the reservoir. On the outer surface of the plunger (13) is provided a groove (15) spiralling at least one turn around the plunger which extends from said oil inlet port (11) to the hole (14) for the oil to flow in and out of the reservoir (12).

Further, on the outer surface of the push rod seat (2) a spiraled groove (17) is formed which extends from said hole (14) for the oil to the outlet port (16) for the oil to flow out of the body. A pressure chamber (18) provided in the body is connected with the reservoir (12) through a check valve (19) and a leak clearance(20) which is connected with the groove (15). A spring (21) is installed between the bottom of the pressure chamber (18) and the plunger (13).

While the engine operates, the oil flows from the oil inlet port (11) into said groove (15) and into the reservoir (12) through the hole (14) for the oil as shown by arrow A. The oil further flows from the hole (14) to outside of the hydraulic lifter through the groove (17)

and the outlet port (16) to circulate as shown by arrow B.

When the engine stops, in FIGS. 1 and 2, the oil in the range from the surfaces (15*a*) and (17*a*) of the grooves (15) (17) to the oil inlet port (11) and outlet port (16) flows out through said inlet port (11) and outlet port (16). However, since the surfaces (15*a*) and (17*a*) of the grooves are located above the ceiling of the internal surface of the reservoir (12), the oil is not left on the surfaces (15*a*) and (17*a*) of the grooves. Accordingly, the oil in the parts ranging from the hole (14) to the surfaces (15*a*) and (17*a*) of the grooves (15) and (17) does not flow to the oil inlet port (11) and the outlet port (16). This prevents the oil in the reservoir (12) from flowing out through the inlet port (11) and outlet port (16), if the engine is stopped.

It should be understood that the preferred embodiments of the present invention have been described herein in considerable detail and that certain modifications, changes, and adaptations may be made therein by those skilled in the art and that it is hereby intended to cover all modification, changes and adaptations thereof falling within the scope of the appended claims.

What is claimed is:

1. A hydraulic lifter of an oil-supplying type for an internal combustion engine comprising:

a cylindrical body installed substantially in a horizontal position and provided with an oil inlet port perforated at the cylindrical wall;

a plunger slidably inserted into the body;

a push rod seat for cup-like shape inserted into one end of said cylindrical body in contact with said plunger, said push rod seat having an oil outlet port formed at the outer circumferential surface;

an oil reservoir formed by the internal surfaces of said plunger and said push rod seat;

a pressure chamber formed by the internal surface of said cylindrical body and the outer end surface of said plunger;

a hole for the oil to flow in and out of the reservoir, provided at a junction portion between said plunger and said push rod seat;

a first groove helically provided on the outer surface of said plunger forming at least one turn around the plunger for connecting said oil inlet port with said hole for the oil to flow in and out of the reservoir; and a second groove helically provided on the outer surface of said push rod seat forming at least one turn around the push rod seat for connecting said hole for the oil to flow in and out of the reservoir with said oil outlet port.

2. A hydraulic lifter for internal combustion engine of claim 1, in which the oil reservoir is connected with the pressure chamber through a check valve located between the end face of the plunger and a pressure chamber and through a leak clearance between the body and the plunger.

* * * * *